United States Patent [19]

Sumino et al.

[11] Patent Number: 4,578,040

[45] Date of Patent: Mar. 25, 1986

[54] FISH LINE ENTERING PREVENTION DEVICE FOR MARINE PROPELLER

[75] Inventors: Yoshitsugu Sumino; Hiroshi Harada, both of Shizuoka, Japan

[73] Assignee: Sanshin Kogyo Kabushiki Kaisha, Japan

[21] Appl. No.: 614,880

[22] Filed: May 29, 1984

[30] Foreign Application Priority Data

May 30, 1983 [JP] Japan ..... 58-94107

[51] Int. Cl.[4] ..... B63H 1/28

[52] U.S. Cl. ..... 440/73; 416/93 A; 416/146 R; 416/146 A; 440/89

[58] Field of Search ..... 440/49, 73, 89; 416/93 A, 146 R, 146 B

[56] References Cited

U.S. PATENT DOCUMENTS 3,952,686 4/1976 Pichl ..... 440/89

4,180,368 12/1979 Henrich et al. ..... 416/93 A

*Primary Examiner*—Sherman D. Basinger

*Attorney, Agent, or Firm*—Ernest A. Beutler

[57] ABSTRACT

Several embodiments of propeller constructions employing an improved fish line and weed cutting device that extends into a recess formed in the lower housing. In each embodiment, the cutting member is disposed radially inwardly of the recess to define a gap and one or more projections extend outwardly from the cutting member to fill the gap and define a narrow area that will prevent the entry of fish lines into the opening of the lower unit that defines the recess.

4 Claims, 9 Drawing Figures

FISH LINE ENTERING PREVENTION DEVICE FOR MARINE PROPELLER

BACKGROUND OF THE INVENTION

This invention relates to a fish line entering preventing device for marine propellers and more particular to an improved fish line cutting device.

It is well known that the area where the propeller of an outboard drive, such as the outboard drive unit of an inboard-outboard drive or the lower unit of an outboard motor, contains an area between the propeller and the lower unit housing in which weeds and fish line may become entangled. Devices have been incorporated that rotate with the propeller and which cooperate with the lower unit housing so as to cut fish lines and weeds so as to prevent their becoming entangled with the propeller shaft. Such cutting devices have been proven to be highly effective. When the fish line is cut, it can be conveniently removed by tilting up the outboard drive and removing the line manually or, alternatively, the fish line or weeds may clear themselves during operation. However, it is necessary to provide some clearance between the cutting device and the lower unit housing and it is conceivable that the fish line may pass through this clearance and become entangled in the propeller shaft internally of the lower unit.

It is, therefore, a principal object of this invention to provide an improved device for cutting fish lines and insuring against their entanglement in the propeller shaft.

It is a further object of this invention to provide a device that is effective not only to cut fish lines from a marine drive but also to insure against the cut pieces from becoming entangled in the drive shaft within the lower unit housing.

SUMMARY OF THE INVENTION

This invention is adapted to be embodied in a fish line cutter or the like for a marine outboard drive having a lower unit housing defining a rearwardly opening annular recess. A propeller shaft is journaled in the lower unit housing and has a portion juxtaposed to the annular recess. A propeller is affixed for rotation with the propeller shaft and is juxtaposed to the recess. A fish line cutting device is affixed for rotation with the propeller shaft and has a portion that extends at least in part into the recess and spaced radially inwardly therefrom for severing fish lines. In accordance with the invention, at least one area on the cutting device extends radially outwardly from the portion and in close proximity to the portion of the housing defining the recess to define a gap that is sized to prevent the entry of fish line past the gap into the recess.

DETAILED DESCRIPTION OF THE PREFERRED EMBODIMENTS

Figure 2:
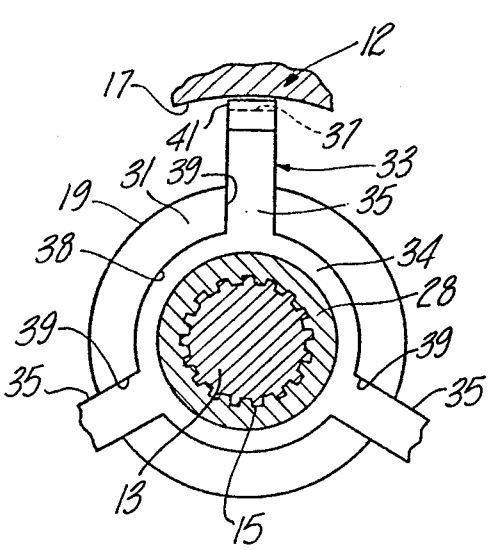
FIG. 2 is a cross-sectional view taken along the line 2 2 of FIG. 1.
Figure 1:
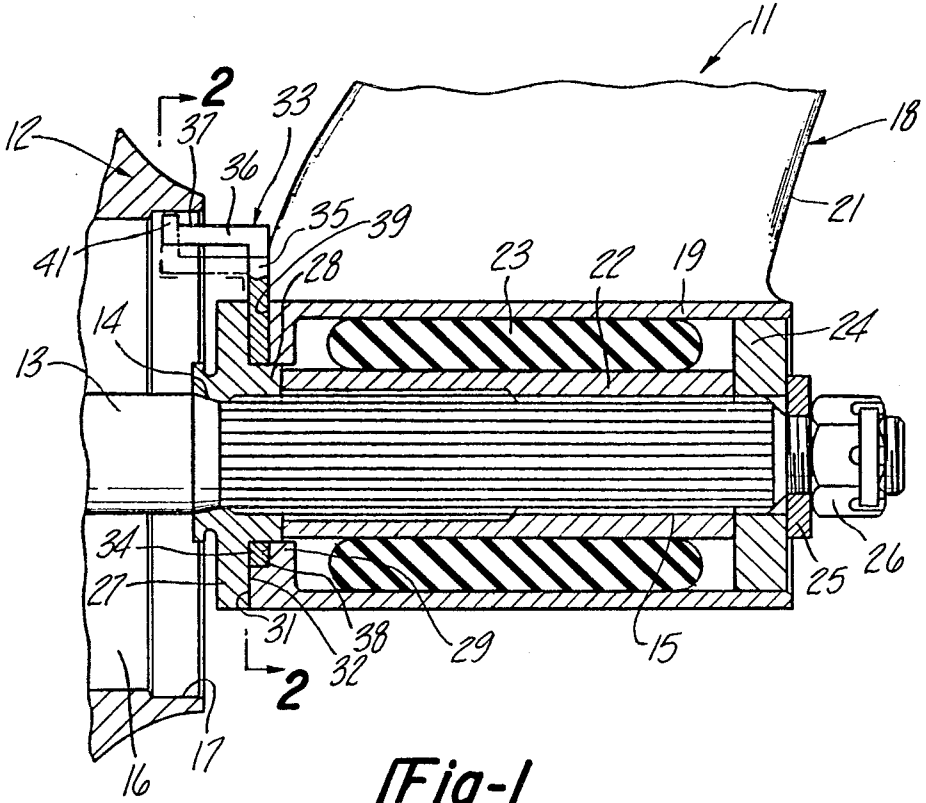
FIG. 1 is a cross-sectional view taken through the propeller shaft of the lower unit of an outboard drive constructed in accordance with a first embodiment of the invention.

Referring first to FIGS. 1 and 2, the reference numeral 11 indicates generally the relevant portion of the lower unit of a marine propulsion device constructed in accordance with a first embodiment of the invention. Inasmuch as the invention relates primarily to the weed and fish line cutting mechanism and its association with the propeller and lower unit, only these components have been illustrated and will be described in detail. The term "lower unit" as used herein and in the claims refers to the lower unit of an outboard motor or the lower unit of the outboard drive portion of an inboard-outboard marine propulsion unit.

The lower unit 11 includes a housing assembly 12 in which a propeller or drive shaft 13 is supported for rotation in any suitable manner. The propeller shaft 13 is driven from either the power unit of the outboard motor or the inboard engine of an inboard-outboard drive in any suitable manner, which may include a forward, neutral, reverse transmission.

The drive shaft 13 is formed with a tapered thrust taking surface 14 adjacent which a rearwardly extending exposed, externally splined portion 15 is provided. The lower unit 12 is provided with an enlarged rearwardly opening cavity 16 which terminates at an annular flange 17 that is concentrically disposed relative to the drive shaft 13. If desired, the passage 16 may be used to discharge exhaust gases beneath the water.

A propeller assembly, indicated generally by the reference numeral 18 is provided for driving the watercraft. The propeller 18 includes an outer hub portion 19 from which one or more propeller blades 21 integrally extend. The outer hub portion 19 is resiliently connected to an inner hub portion 22 by means of an elastomeric sleeve 23 which is contained between the hub portions 19 and 22 and is held in place in any suitable manner, as by bonding. The elastomeric sleeve 23 is provided so as to afford vibration damping and is generally effective in a torsional or circumferential rather than in an axial direction.

The inner hub 22 is internally splined so as to afford a connection with the drive shaft splines 15 that affixed the hub 22 non-rotatably to the drive shaft 13. The inner hub 22 is fixed axially relative to the drive shaft 13 by an arrangement which includes an annular member 24 positioned at the rear end of the outer hub 19 and which is engaged by a washer 25 and held in place by a nut 26 received on a threaded end of the drive shaft 13 so as to preclude inadvertent rearward disassembly of the propeller 18 from the drive shaft 13.

At the forward ends of the drive shaft splines 13, a thrust taking member or washer 27 is provided that has an inner face which is engaged with the drive shaft thrust taking surface 14. The thrust taking member 27 has a hub portion 28 that is engaged by the inner hub 22 so as to axially fix the thrust taking member 27 and inner hub 22 relative to the drive shaft 13.

The outer hub 19 has, at its forward end, an inwardly extending flange 29 that defines a forwardly facing surface or shoulder 31 that is normally engaged with a rearwardly facing shoulder 32 of the thrust member 27 so as to provide a positive mechanical connection between the propeller 18 and the thrust member 27 for transferring the driving thrust from the propeller 18 to the lower unit.

A combined fish line and weed cutting member, indicated generally by the reference numeral 33 and constructed in accordance with this embodiment, is provided which is rotatably coupled with the propeller 18, axially fixed between the propeller 18 and the thrust taking mamber 27 and which, nevertheless, does not interfere with the axial positioning of the propeller 18 relative to the thrust taking member 27. The fish line and weed cutting member 33 may be conveniently formed from sheet metal or the like. The member 33 has a generally annular inner surface 34 that is planar and from which a plurality of arms 35 extend in generally the same plane. The center portion 34 and arms 35 are of the same thickness. The outer ends of the arms 35 are forwardly bent, as at 36, and may be generally curved along their outer face. These forwardly projecting arms 36 have surfaces 37 that extend into close proximity to the lower housing recess 17 but which leave a gap between the recess 17, as shown in FIG. 1, so as to perform their fish line and weed cutting function, as will be described.

A recess is formed between the forward face of the propeller outer hub 19 and specifically its surface 31 and the mating surface 32 of the thrust taking member 27. In this embodiment, this recess is formed completely in the propeller hub portion 29 and consists of a generally annular section 38 that is complementary to the weed cutter hub portion 34 and a plurality of radially extending recesses 39 which are complementary in number and size to the arms 35. As a result of this configuration, the weed and fish line cutting member 33 will be clamped in the recess consisting of the portion 38 and the recesses 39 and held against rotation. However, the positioning of the member 33 in this area will not interfere with the direct thrust engagement between the propeller hub surface 31 and the thrust member surface 32. Therefore, the fish line and weed cutting member 33 is held both axially and circumferentially between these two members but it does not prevent or determine their axial engagement.

As has been noted, the surfaces 37 are spaced inwardly from the flange 17 so as to define a gap. Thus, even though fish line may be cut by the arms 36, there is still a possibility that it can become entwined around the propeller shaft 13. In order to prevent the entry of such fish line into the cavity 16, the arms 36 are provided with outwardly extending projections 41 at their inner extremities which lie extremely close to the inner surface of the flange 17. These extremities or projections 41 are spaced much more closely to the flange surface than are the surfaces 37 and are spaced at a thickness that is no greater than the thickness of fish line so that it cannot enter into the gap and become contaminated in the cavity 16.

In this embodiment, the arms 36 have their surfaces 37 spaced closely adjacent the flange 17. As shown in the phantom line view in FIG. 1, it also is possible to have the surfaces 37 disposed a greater distance inwardly from the flange 17 as long as the projections 41 still are closely spaced to this flange surface.

Figure 4:
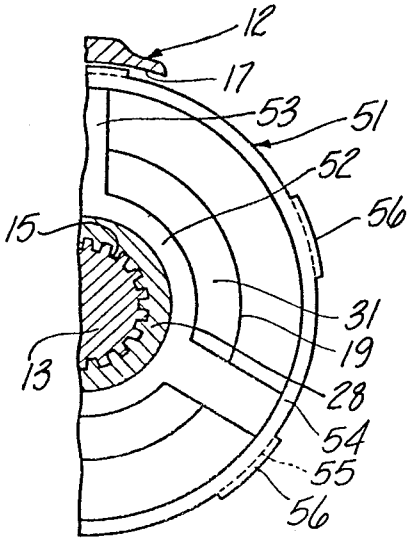
FIG. 4 is a cross-sectional view taken along the line 4—4 of the embodiment of FIG. 3.
Figure 3:
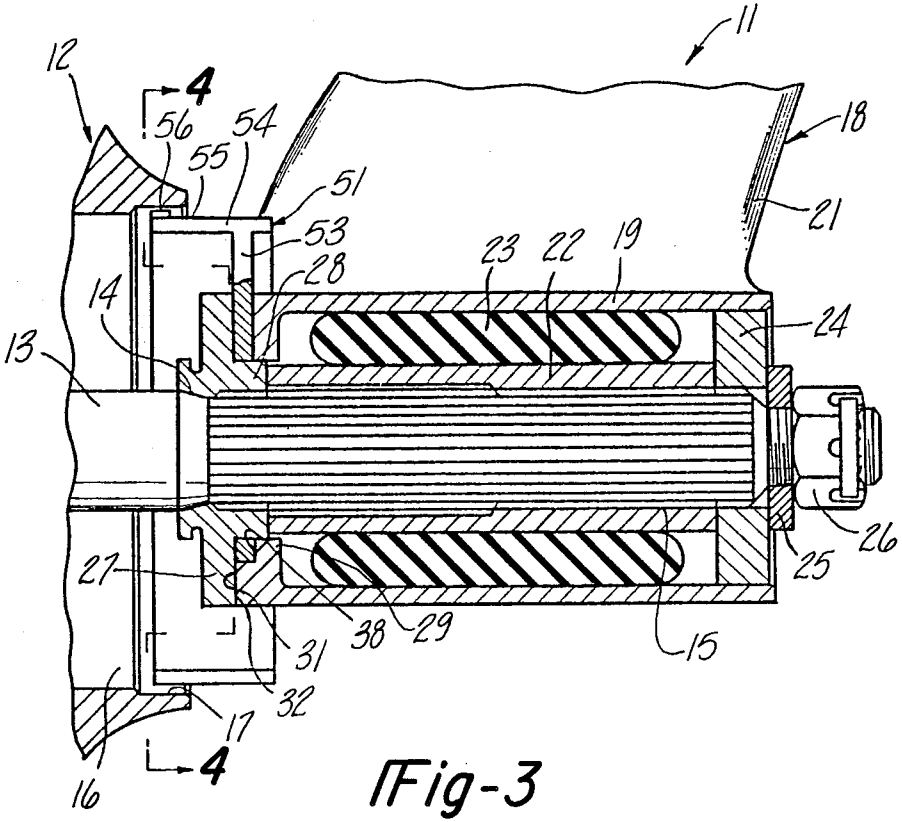
FIG. 3 is a cross-sectional view, in part similar to FIG. 1, showing a second embodiment of the invention.

A weed cutter constructed in accordance with another embodiment of the invention is shown in FIGS. 3 and 4 and is identified generally by the reference numeral 51. The remaining construction of the propeller, drive shaft and drive shaft housing is the same as the embodiment of FIGS. 1 and 2 as is the manner of retention of the weed cutter 51 relative to the propeller 18. For that reason, the components which are the same in the previously described embodiment have been identified by the same reference numerals and will not be described again.

In this embodiment, the weed cutting member 51 has an annular inner ring 52 that is received in the recess 38 of the outer hub 19 and specifically of its flange portion 29. A plurality of ribs 53 extend radially outwardly from the ring portion 52 through respective grooves in the hub 19 so as to non-rotatably affix the weed cutting member 51 with the propeller 18 as in the embodiment of FIGS. 1 and 2. In accordance with this embodiment, the outer ends of the radially extending members 53 are integrally connected to an annular axially extending member 54 that extends forwardly into the recess 17 and which has its outer surface 55 spaced inwardly from the recess 17 as with the previously described embodiment.

The radially extending members 53 define air gaps therebetween so as to freely pass exhaust gases out of the flange 17 and opening 16 if the exhaust gases are discharged from the associated engine in this manner.

In accordance with the invention, the annular member 54 is provided with a series of circumferentially spaced projections 56 that extend in close proximity to the inner surface of the flange 17 so as to prevent the entry of cut fish lines into the opening 16, as with the embodiment of FIGS. 1 and 2.

Figure 6:
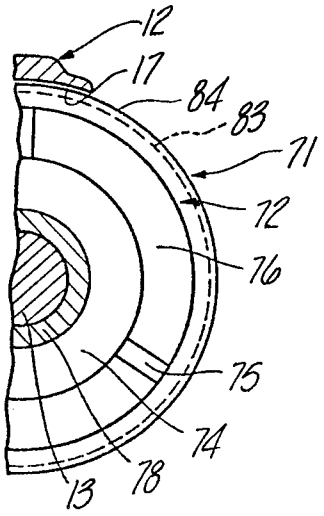
FIG. 6 is a cross-sectional view taken along the line 6—6 of FIG. 5.
Figure 5:
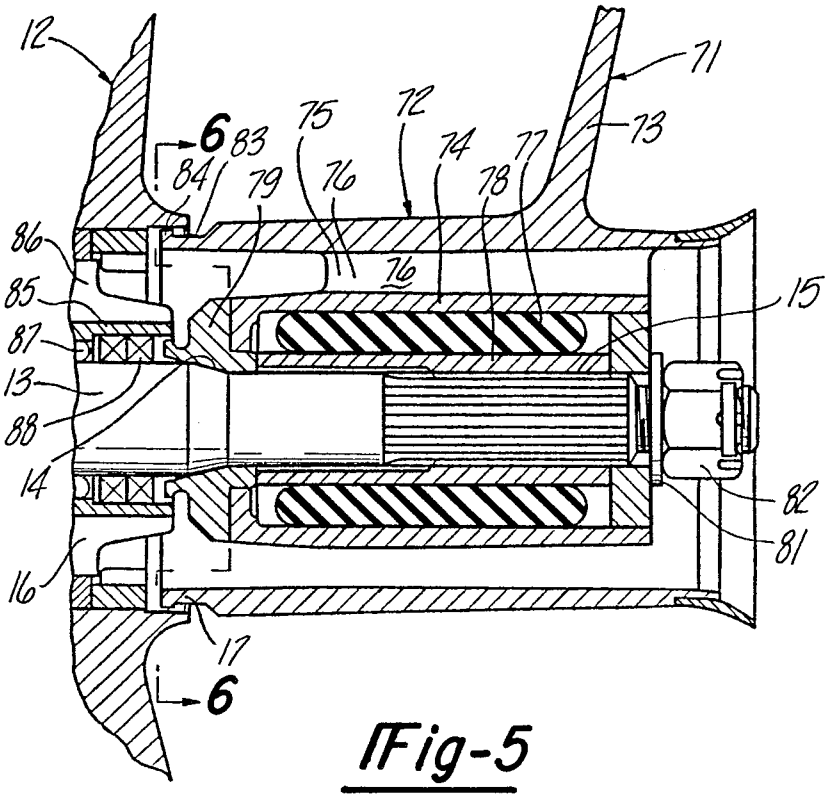
FIG. 5 is a cross-sectional view, in part similar to FIGS. 1 and 3, showing a third embodiment of the invention.

A propeller constructed in accordance with a further embodiment of the invention is identified generally by the reference numeral 71 in the embodiment of FIGS. 5 and 6. In accordance with this invention, the lower unit 12 and propeller shaft 13 have the same construction as the embodiments previously described and, for that reason, the components which are the same have been identified by the same reference numeral and will not be described again in detail, except insofar as is necessary to understand the construction and operation of this embodiment.

The propeller 71 is comprised of an outer hub 72 from which blades 73 integrally extend. The outer hub 72 is connected an inner hub 74 by means of a plurality of integral ribs 75 which define air gaps 76 therebetween so as to permit the flow of exhaust gases through the hub of the propeller in a known manner.

The inner sleeve 74 is affixed to the periphery of an elastomeric sleeve 77 in a suitable manner which sleeve is, in turn, affixed to an inner sleeve 78. The inner sleeve 78 has internal splines that are engaged with the splines 15 of the drive shaft 13 so as to rotatably couple the shafts together.

The inner propeller hub 74 engages a thrust member 79, which is engaged with the drive shaft thrust shoulder 14 so as to transmit driving thrust to the lower unit 12. The propeller 71 is held axially on the shaft 13 by means of a washer 81 and nut 82, as in the previously described embodiment.

In this embodiment, the outer propeller hub 72 is provided with a reduced diameter, forwardly extending section 83 that extends into the flange 17 and which is spaced radially inwardly from it to define a gap, as in the previously described embodiments. In accordance with this embodiment, the portion 83 is provided with a radially outwardly extending projection 84 that extends into close proximity to the flange 17 so as to prevent the entry of foreign materials into the opening 16. In this embodiment, the projection 84 is continuous.

It should be noted that FIG. 5 shows a portion of the support for the drive shaft 13 which includes an inner sleeve 85 that is supported by the lower unit through a plurality of ribs 86 that define gaps for the cavity 16 through which exhaust gases may pass. An anti-friction bearing 87 is positioned within the sleeve 85 for rotatably journaling the rear portion of the drive shaft 13 and a seal 88 protects the bearing 87.

Figure 8:
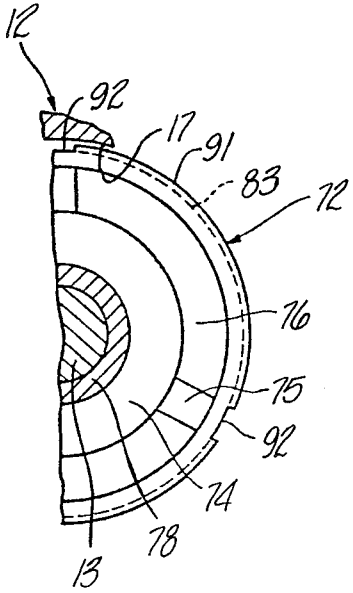
FIG. 8 is a cross-sectional view, taken along a plane corresponding to the plane of FIGS. 2, 4 and 6, but showing the embodiment of FIG. 7.
Figure 7:
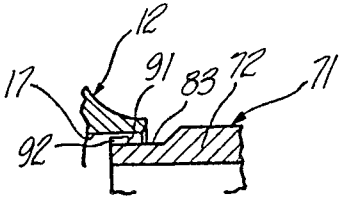
FIG. 7 is a partial cross-sectional view, taken along a plane similar to the planes of FIGS. 1, 3 and 5, showing a further embodiment of the invention.

In the embodiments of FIGS. 5 and 6, the projection 84 was, as has been noted, continuous. It is also possible to provide a series of spaced projections and FIGS. 7 and 8 show such an embodiment. Since only the construction of the projections differs from the embodiment of FIGS. 5 and 6, all other components have been identified by the same reference numerals.

In this embodiment, the forward end of the recessed portion 83 is provided with a plurality of circumferentially spaced projections 91 that are spaced apart by gaps 92. The projections 91, as in the previously described embodiment, are disposed in close proximity to the flange 17 so as to prevent the entry of fish line into the cavity 16.

Figure 9:
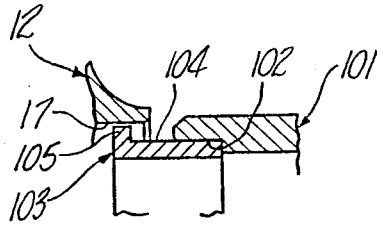
FIG. 9 is a partial cross-sectional view, taken along the same plane as FIGS. 1, 3, 5 and 7, showing a still further embodiment of the invention.

In the embodiment of FIGS. 5 and 6 and 7 and 8, the weed cutting and fish line entry preventing members were formed integrally with the outer hub of the propeller. Rather than being formed integrally with it, they may be formed as a separate element that is press fit into the outer hub of the propeller 71 and FIG. 9 shows an embodiment having such a construction. In this embodiment, a propeller hub 101, which may be of the same general construction as the propeller 71 of the embodiment of FIGS. 5 and 6, has a recessed or counterbored forward portion 102 into which a combined weed cutting and fish line preventing member 103 is press fit. The member 103 has a cylindrical portion 104 that is press fit into the bore 102 and which extends forwardly and inwardly of the flange 17 of the lower unit 12. Either a continuous projection 15 may be formed at the forward end of this portion so as to prevent the entry of fish line, as in the embodiment of FIGS. 5 and 6, or discontinuous projections may be formed as in the embodiment of FIGS. 7 and 8.

It should be readily apparent from the foregoing description that several embodiments of the invention have been disclosed, each of which is effective in cutting fish line and which prevents the entry of the cut fish line from entering into the lower unit cavity forwardly of the propeller. This is achieved by projections that are spaced closely from the cavity but because of their relatively small size, close tolerances need not be maintained for the overall construction.

Although several embodiments of the invention have been illustrated and described, various changes and modifications may be made, without departing from the spirit and scope of the invention, as defined by the appended claims.

We claim:

1. In a fish line cutter or the like for a marine outboard drive having a lower unit housing defining a rearwardly opening annular recess, a propeller shaft journaled in said lower unit housing and having a portion juxtaposed to said annular recess, a propeller affixed for rotation with said propeller shaft and juxtaposed to said recess, and a fish line cutting device affixed for rotation with said propeller shaft and having a plurality of circumferentially spaced cutting edges disposed rearwardly of and in proximity to said recess, each of said cutting edges further having a portion extending axially forwardly at least in part into said recess and spaced radially inwardly from said recess to define a gap, the improvement comprising at least one area on said cutting device extending radially outwardly from each of said portions axially within said annular recess and in close proximity to the portion of said housing defining said recess to define a space sized to prevent the forward entry of fish line past said cutting edges and said gap into said recess.

2. In a fish line cutter as set forth in claim 1 wherein the fish line cutting device comprises a plurality of spaced members extending into the housing recess and defining circumferentially extending gaps therebetween.

3. In a fish line cutter as set forth in claim 2 wherein the spaced members are integrally connected to each other through a common annular shaped portion.

4. In a fish line cutter as set forth in claim 3 wherein the annular portion is affixed for rotation with the propeller and is in thrust bearing relation with the propeller shaft.

* * * * *